US011255062B2

(12) United States Patent
Duncan et al.

(10) Patent No.: US 11,255,062 B2
(45) Date of Patent: Feb. 22, 2022

(54) UNIVERSAL BLOCK PLATFORM LOWER PLATFORM BLOCK AND METHOD OF USE

(71) Applicant: FMC Technologies, Inc., Houston, TX (US)

(72) Inventors: Iain Duncan, Houston, TX (US); Graham Horn, Singapore (SG); Shree Akhave, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/769,153

(22) PCT Filed: Dec. 6, 2018

(86) PCT No.: PCT/US2018/064326

§ 371 (c)(1),
(2) Date: Jun. 2, 2020

(87) PCT Pub. No.: WO2019/113367

PCT Pub. Date: Jun. 13, 2019

(65) Prior Publication Data

US 2021/0214907 A1 Jul. 15, 2021

Related U.S. Application Data

(60) Provisional application No. 62/595,369, filed on Dec. 6, 2017.

(51) Int. Cl.
*E02B 17/02* (2006.01)
*E02B 17/00* (2006.01)
(Continued)

(52) U.S. Cl.
CPC ..... *E02B 17/02* (2013.01); *E02B 17/0004* (2013.01); *E02B 17/0008* (2013.01);
(Continued)

(58) Field of Classification Search
CPC ..... E02B 17/02; E02B 2017/0043; E02B 2017/0095; E02D 13/04; E02D 27/525
See application file for complete search history.

(56) References Cited

U.S. PATENT DOCUMENTS 4,100,753 A * 7/1978 Mott ..... E02B 17/027 166/351
4,666,340 A 5/1987 Cox
(Continued)

FOREIGN PATENT DOCUMENTS

CN 202176267 U 3/2012
CN 202718076 U 2/2013
(Continued)

OTHER PUBLICATIONS

International Search Report and Written Opinion dated Mar. 21, 2019 for PCT/US2018/064291.
(Continued)

*Primary Examiner* — Sean D Andrish
(74) *Attorney, Agent, or Firm* — Osha Bergman Watanabe & Burton LLP

(57) ABSTRACT

A method includes mounting a lower platform block (300) to a plurality of piles (215) positioned on a surface. The lower platform block includes a first frame (315), a plurality of docking assemblies (305) connected to the first frame and engaging the piles, and a plurality of conductor tubes (310) connected to the first frame to a plurality of piles. The docking assemblies are released from the piles to separate the lower platform block from the piles.

10 Claims, 14 Drawing Sheets

(51) Int. Cl.

| | |
|---|---|
| ***E02D 13/04*** | (2006.01) |
| ***E02D 27/52*** | (2006.01) |
| ***E21B 43/017*** | (2006.01) |
| ***E21B 43/01*** | (2006.01) |
| ***E21B 43/17*** | (2006.01) |

(52) U.S. Cl.

CPC ..... *E02B 17/027* (2013.01); *E02D 13/04* (2013.01); *E02D 27/52* (2013.01); *E02D 27/525* (2013.01); *E21B 43/01* (2013.01); *E21B 43/017* (2013.01); *E21B 43/17* (2013.01); *E02B 2017/0039* (2013.01); *E02B 2017/0043* (2013.01); *E02B 2017/0052* (2013.01); *E02B 2017/0078* (2013.01); *E02B 2017/0095* (2013.01)

(56) References Cited

U.S. PATENT DOCUMENTS

| | | | | |
|---|---|---|---|---|
| 4,669,918 | A | 6/1987 | Riles | |
| 4,867,611 | A | 9/1989 | Luyties | |
| 5,669,735 | A | 9/1997 | Blandford | |
| 2013/0272796 | A1* | 10/2013 | Horton, III | E02B 17/027 405/204 |
| 2015/0240440 | A1 | 8/2015 | Johns et al. | |
| 2017/0009480 | A1 | 1/2017 | Bucknell et al. | |

FOREIGN PATENT DOCUMENTS

| | | | |
|---|---|---|---|
| WO | 99/47784 | A1 | 9/1999 |
| WO | 02/46537 | A1 | 6/2002 |
| WO | 2017099672 | A1 | 6/2017 |

OTHER PUBLICATIONS

International Search Report and Written Opinion dated Mar. 21, 2019 for PCT/US2018/064306.

International Search Report and Written Opinion dated Mar. 19, 2019 for PCT/US2018/064314.

International Search Report and Written Opinion dated Mar. 21, 2019 for PCT/US2018/064326.

* cited by examiner

UNIVERSAL BLOCK PLATFORM LOWER PLATFORM BLOCK AND METHOD OF USE

TECHNICAL FIELD

The present disclosed subject matter generally relates to the field of oil and gas well production and, in one particular example, to a universal block platform including a lower platform.

BACKGROUND

The development of marginal offshore fields is made difficult due to the costs associated with field development. Producers are unlikely to secure internal sanction to allow the development of marginal fields to proceed. Factors that can affect the sanction point can range from basic capital expenditure (CAPEX) efficiency, deployment issues, life-cycle operating and maintenance costs. In some cases, complex production scenarios raise additional issues, such as where the host or tie in point cannot handle the raw product being produced. In such situations, the initial cost estimation for the development can be burdened by increased drilling cost, complex platform and utility design to manage the product, and the installation cost for the platform and flowlines or umbilicals. These costs, coupled with the extended time to build and deliver the complete customized and engineered structure, results in a high CAPEX cost, with high multi-contract and high multi-interface risks. The net effect of these contributing factors leads producers to leave these types of reserves dormant, resulting in marginal stranded reserves.

The present application is directed to a universal block platform that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

An apparatus includes a lower platform block. The lower platform block includes a first frame, a plurality of docking assemblies connected to the first frame, a plurality of conductor tubes connected to the first frame, and a first plurality of releasable connectors connected to the conductor tubes.

A method includes mounting a lower platform block to a plurality of piles positioned on a surface. The lower platform block includes a first frame, a plurality of docking assemblies connected to the first frame and engaging the piles, and a plurality of conductor tubes connected to the first frame to a plurality of piles. The docking assemblies are released from the piles to separate the lower platform block from the piles.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
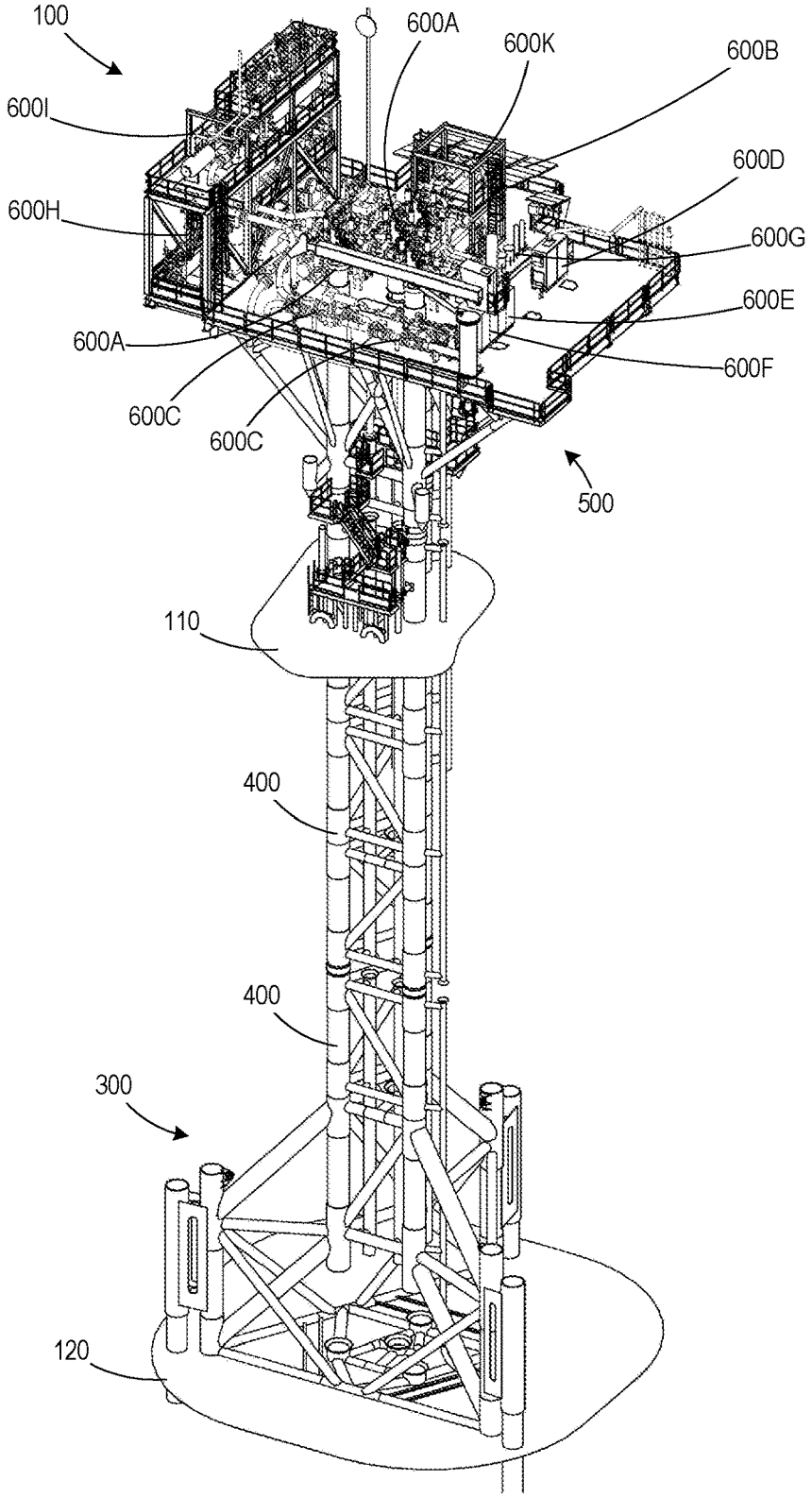
FIG. 1 is a perspective view of a universal block platform, according to some embodiments disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

One illustrative example of a universal block platform 100 will be described with reference to the attached drawings. FIG. 1 is a perspective view of the universal block platform 100, according to some embodiments disclosed herein. The universal block platform 100 includes a foundation block 200 (shown in FIG. 2), a lower platform block 300, one or more jacket connector blocks 400, a platform deck block 500, and one or more production blocks 600A-600K. Sea level is represented by surface 110, and the sea floor is represented by surface 120. The platform deck block 500 includes flexible receptacles that allow a flexible configuration of the production blocks 600A-600K such that they may be removed and/or replaced during the platform life cycle without any offshore construction work to optimally utilize the production facility for the actual production scenarios. This arrangement allows the universal block platform 100 to support different production scenarios, for oil, gas, and produced water separation, cleanup, discharge to sea, and sand control on a plug and play basis into the platform deck block 500. Example production blocks include one or more manifold module(s), a flow metering module, an over-pressure protection system (OPPS) module, a process/dewatering module, a subsea flowline pig receiver module, an export pig launcher module, an instrument gas package module, a well control panel module, a topside umbilical termination assembly (TUTA), a microturbine power generation module, a chemical injection module, a vent/drain module, a sand control system, and an export metering or fiscal metering package.

Multiple jacket connector blocks 400 may be employed depending on water depth (e.g., from 10 ft-300 ft). The blocks 200, 300, 400, 500 have interfacing connectors that allow them to be "snapped" together in the field to facilitate the fabrication of the universal block platform 100 without heavy on-site construction equipment. Smaller construction equipment, such as a barge, lift vessel, or drilling rig, may be employed. The universal block platform 100 is capable of handling a wide variety of well fluids (e.g., oil, gas, water) in any combination and in sweet or sour conditions. Due to the "snap" connectors provided for securing the blocks 200, 300, 400, 500, the universal block platform 100 may be fully recovered and redeployed in a different location without the use of heavy lift or construction vessels.

Figure 2:
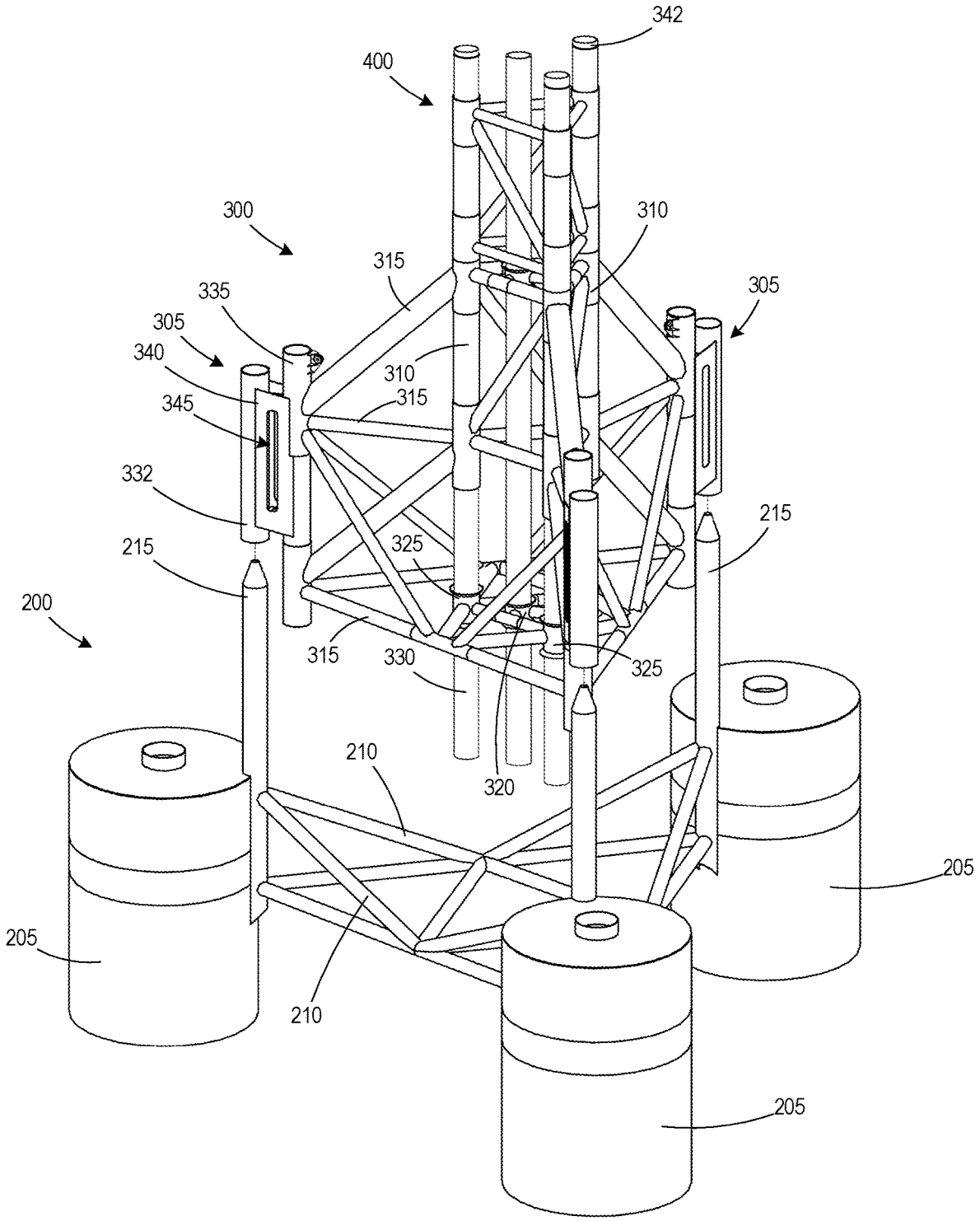
FIG. 2 is a perspective view of a foundation block interfacing with a lower foundation block, according to some embodiments disclosed herein.

FIG. 2 is a perspective view of the foundation block 200, the lower platform block 300, and a portion of a jacket connector block 400, according to some embodiments disclosed herein. In some embodiments, the foundation block 200 includes a plurality of suction cans 205 interconnected by a frame 210 In some embodiments, the universal block platform 100 has a tripod configuration, as illustrated in FIGS. 1-4J. The foundation block 200 is optional in that not all deployments may have solid conditions that support the use of suction cans 205. Other techniques, such as pilings, may be used to secure the universal block platform 100 in such deployments. Each suction can 205 includes installation valves for remote operating vehicle (ROV) or surface supplied installation and recovery. An integrated pile system allows for easy recovery. Each suction can 205 includes an associated pile 215 where the lower platform block 300 can land and lock into place. In some embodiments, the locking system may employ a land and grout method. In some embodiments, hydraulic latching connectors are provided for securing the lower platform block 300 to the foundation block 200. The foundation block 200 is sized to suit the platform maximum operating weight and a variety of international seabed conditions. The seabed conditions dictate whether the foundation block 200 is used and set as a conventional suction structure or combined with conventional piles.

The lower platform block 300 includes docking assemblies 305 and conductor tubes 310 supported by a frame 315. The frame 315 also supports a center conductor guide 320 and outer conductor guides 325 that guide the conductors 330 (shown in phantom) as they are inserted. In some embodiments, the conductor guides 320, 325 may have an upwardly-extending funnel shape to account for misalignment with the conductors 330 during insertion, the conductor guides 320, 325 are positioned to comply with the allotted well bay slots in the platform deck block 500. The conductor guides 320, 325 provide a secure method for the drilling team to run and cement the well conductors 330. In some embodiments, the conductor guides 320, 325 are configured to support the running and landing of a mud line suspension system (MLS) to facilitate the development of the offshore fields when the platform is not in position. In some embodiments, the conductor guides 320, 325 are set in a predetermined pattern to preserve the well slot position, enabling the jacket connectors 400 and platform deck block 500 to be directly interfaced with the lower platform block 300 and the wells.

The docking assemblies 305 each includes a piling tube 332 and a frame tube 335 connected to the piling tube 332 by a web 340. The web 340 allows for separation (i.e., for recovery) of the lower platform block 300 from the foundation block 200 when utilized, or a driven structural support pile if used. In some embodiments, a cutting tool may be used to cut the web 340 to allow retrieval of the lower platform block. Note that the web 340 has an interior window 345 that reduces the amount of material needed to be cut to separate the lower platform block 300 front the foundation block 200. In some embodiments, the piling tube 332 interfaces with a pile 215 of the foundation block 200. The sacrificial nature of the docking assemblies 305, which form the structural link between the lower platform block 300 and the foundation block 200 or structural supporting pile, allow the lower platform block 300 to be cut away for to improve decommissioning and reduce the refurbish time for re deployment. The docking assemblies 305 provide full structural support for the platform during its operational life, while retaining the ability to be quickly cut away and recovered. The lower foundation block 300 includes connectors 342.

Figure 3A:
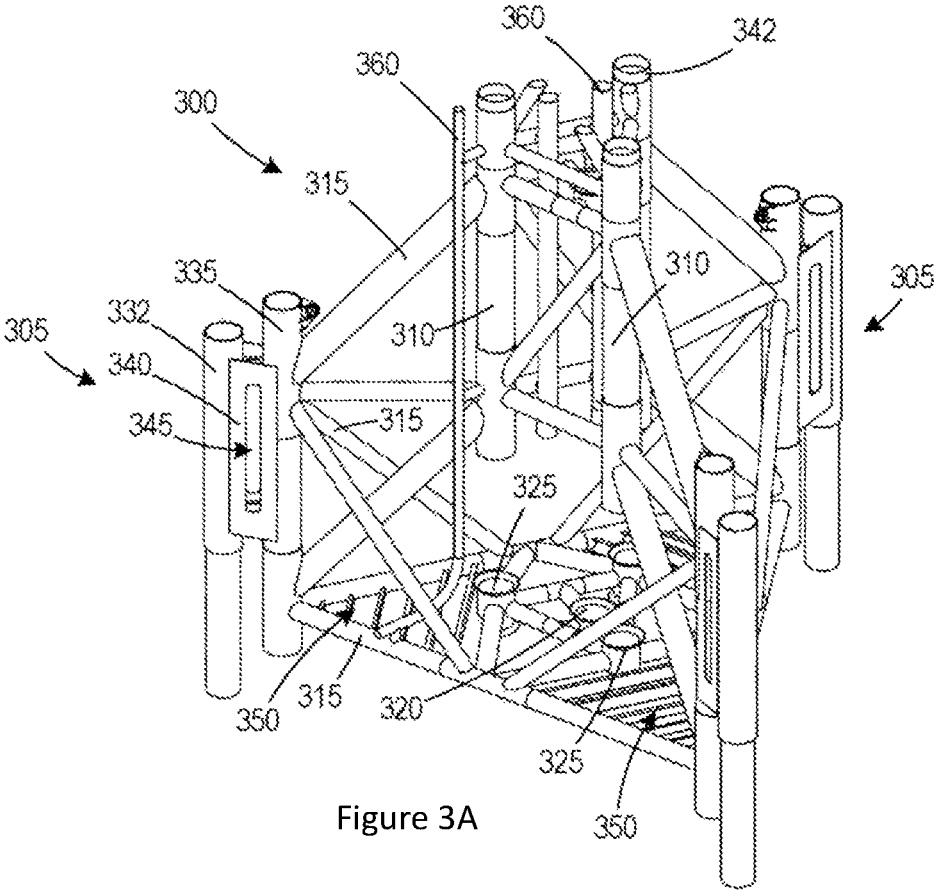
FIGS. 3A-3E shows perspective views of a lower platform block, according to some embodiments disclosed herein.
Figure 3B:
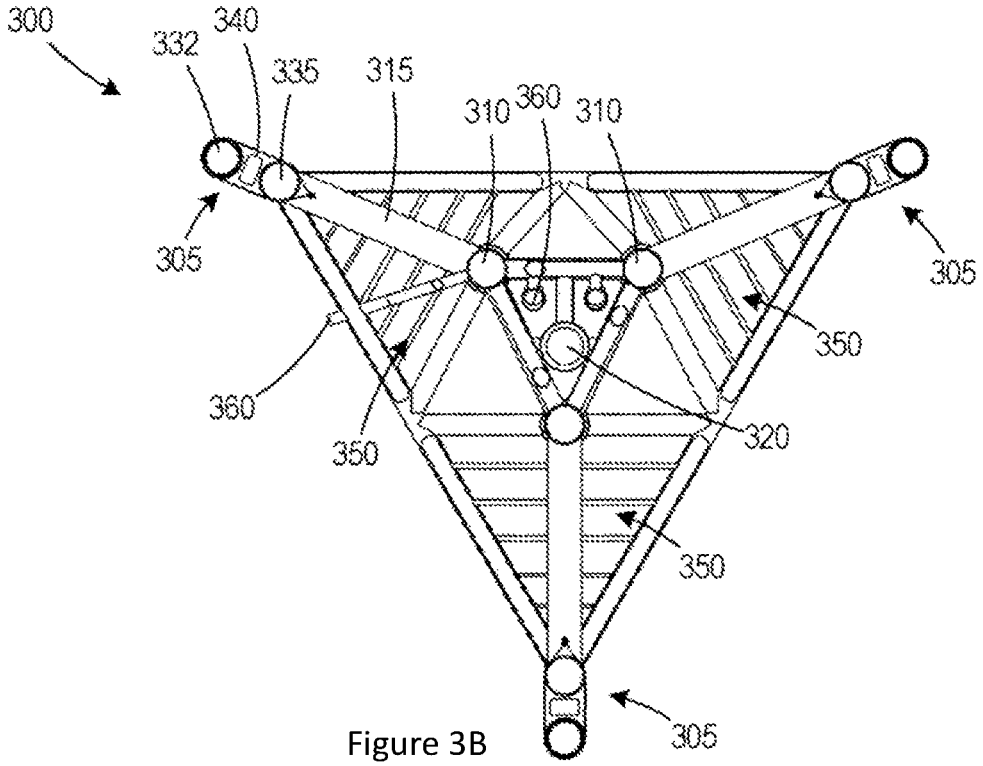

FIGS. 3A and 3B include perspective views of an alternative embodiment of the lower platform block 300 adapted for use without the foundation block, according to some embodiments disclosed herein. In some embodiments, where the foundation block 200 is omitted, the piling tubes 332 may interface with pilings driven into the sea floor. In some embodiments, the lower platform block 300 includes mud ats 350 supported by the frame 315 and defined by a plurality of wing members 355. In some embodiments, the wing members 355 span across elements of the frame 315 that define a triangular opening. In some embodiments, the frame 315 supports integrated accessory lines 360 (e.g., umbilical or import/export lines) with connector or flanged connections.

Figure 3C:
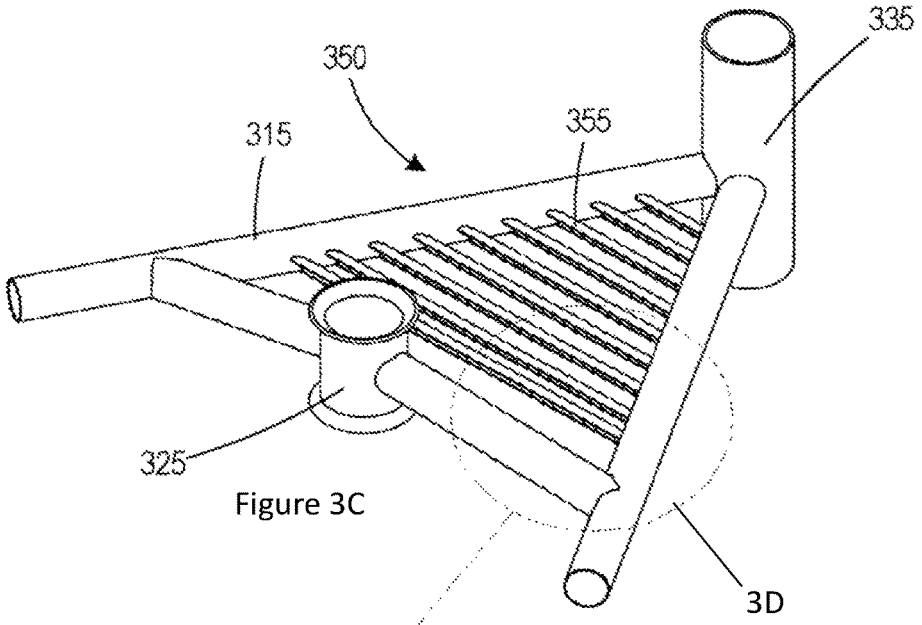
Figure 3D:
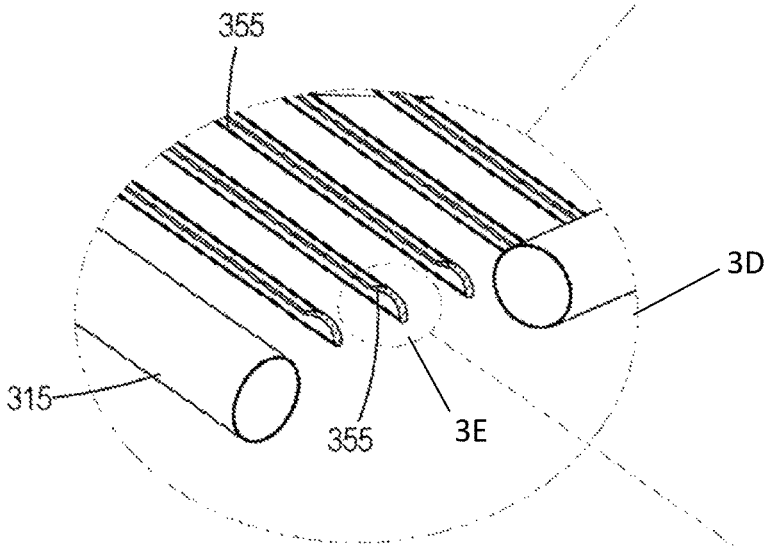
Figure 3E:
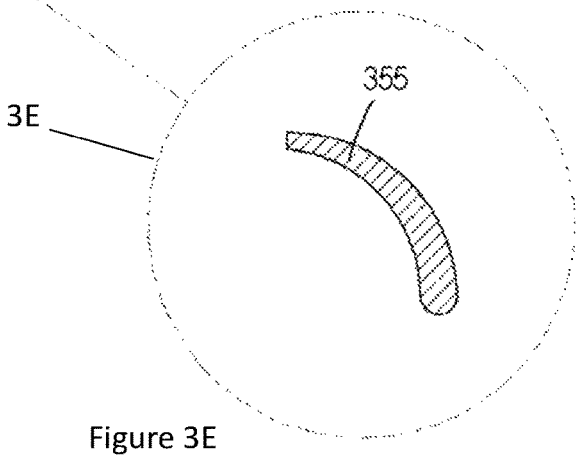

FIGS. 3C-3E include perspective views of the mudmats 350, in accordance with some embodiments. In some embodiments, the wing members .355 have an arcuate cross-section shape. In some embodiments, the wing members 355 have an increasing thickness along the length of an arc of the arcuate cross-section. The mudmats 350 serve to spread the load in difficult soil conditions to further increase the initial support of the lower platform block 300. The angle and number of wing members 355 can be varied to adapt to different sea bed configurations and structural loads.

In some embodiments, the lower platform block 300 allows a "keel" joint of conductor pipe to be passed through the center conductor guide 320 to provide initial stabilization during installation and to provide a support for the pile driving process. The "keel" joint can be run and retrieved, or permanently set if required to secure the vertical orientation of the lower platform block 300. The lower platform block 300 employs a fixed drill guide, enabling significant reduction in setup and drilling time, where the overall mobilization and location set up can be compressed by providing a fixed well location. The application and use of the lower platform block 300 allows pre-drilling of the wells using a mud line suspension system (MLS). This advantage further adjust the project's capital expenditure and provides a low-cost exploration solution for early development wells or fields.

The lower platform block 300 provides the main anchor point for any infield flowlines or pipelines required for product export or injection, and in some embodiments, an anchor point for control and/or power umbilical lines. These connections are located at set points and elevations to enable both flow/pipeline and the umbilical connections to be integrated into the lower platform block 300, and tied into the jacket connector 400 and platform deck block 500, allowing easy installation and recovery for reuse. The ability to incorporate these functions within a single structure enables the decoupling of the drilling and installation process. The lower platform block 300 and flow/pipelines along with any umbilical requirements can be deployed and set off the project's critical path, further decoupling the linear nature of these offshore projects. This arrangement allows for a vessel of opportunity to be utilized for the installation of the lower platform block 300, foundation block 200, and flow/pipeline installation, further reducing the capital expenditure of the development. The design of the foundation block 200 and the lower platform block 300 enables a drilling rig to install these blocks 200, 300 if required, supported by a lay vessel or barge. The drilling rig can use the main draw works to pick the foundation block 200 and/or the lower platform block 300 off the transport vessel and install them on the sea bed. The drilling rig can additionally pick up and install the flow/pipeline and umbilical connections. In some embodiments, the foundation block 200 and lower platform block 300 are deployed in a similar manner from a deck barge using a crawler crane, or a dedicated vessel, where the installation process follows the same processes.

The foundation block 200 and the lower platform block 300 are re-deployable, where the platform blocks 200, 300 can be disconnected from each other or removed as a single unit. Once the platform structure has been recovered the flow/pipelines and umbilical's can be left in place or recovered.

Figure 4A:
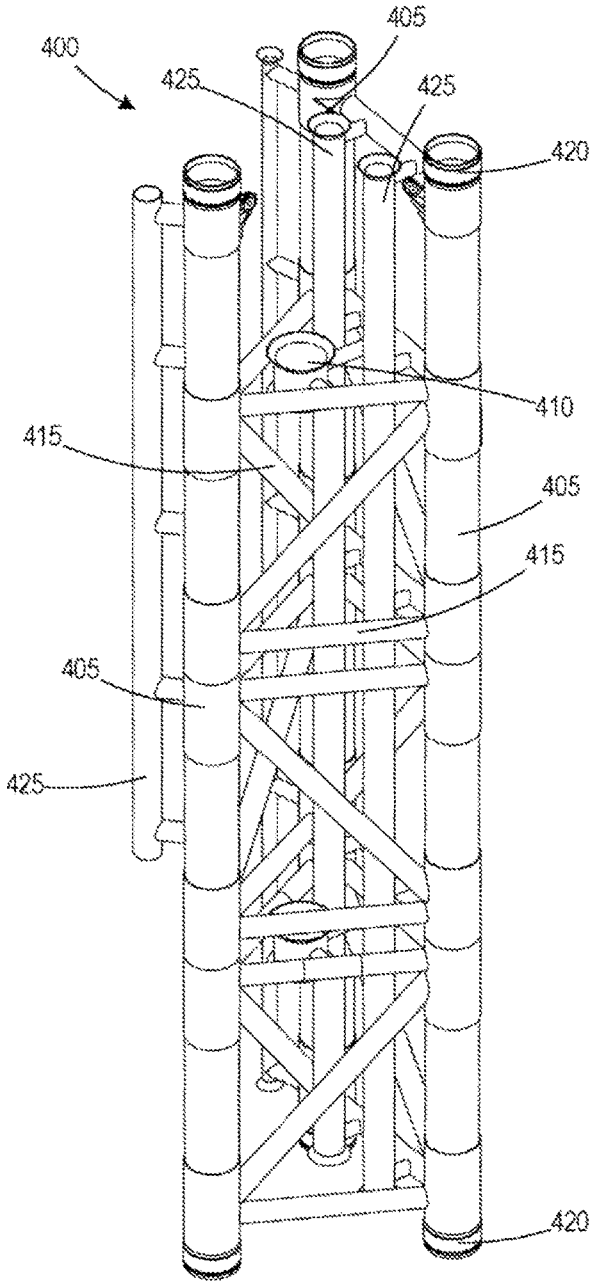
FIGS. 4A-4J shows perspective views of a jacket connector block, according to some embodiments disclosed herein.
Figure 4B:
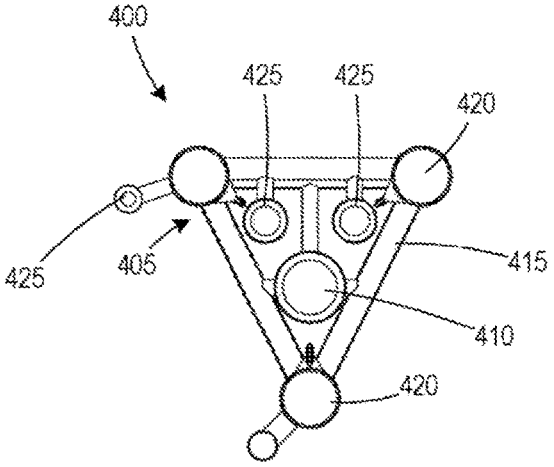

FIGS. 4A and 4B show perspective views of the jacket connector block 400, according to some embodiments disclosed herein. The jacket connector block 400 includes conductor tubes 405 and a center conductor guide 410 supported by a frame 415. The center conductor guide 410 may have an upwardly-extending funnel shape to account for misalignment with the conductors 330 during insertion. The conductor tubes 405 are unobstructed to allow the insertion of conductors 330. The conductor tubes 405 include top and bottom (e.g., male and female) connectors 420 that lock to the mating connectors 342 of the lower platform block 300, the connectors 420 of another jacket connector block 400, or connectors 520 of the platform deck block 500 to allow for attaching and separating (i.e., for recovery) jacket connector blocks 400 from the lower platform block 300. The connectors 420 may be operated remotely. The frame 415 also supports integrated accessory lines 425 (e.g., umbilical, import/export, I-tubes, etc.) with connector or flanged connections. Multiple jacket connector blocks 400 may be provided to account for the water depth at the installation site. In some embodiments, the multiple jacket connector blocks 400 have different lengths. The conductor tubes 405 protect the conductors 220 from impact by a service vessel or boat and attracting additional wave load by the conductor 220. The jacket configuration stays the same in the wave zone irrespective of water depth and that makes the wave load on the universal block platform 100 the same over all water depths. There are no obstructions in the conductor tubes 405 enabling large bore well conductors to be run.

Figure 4C:
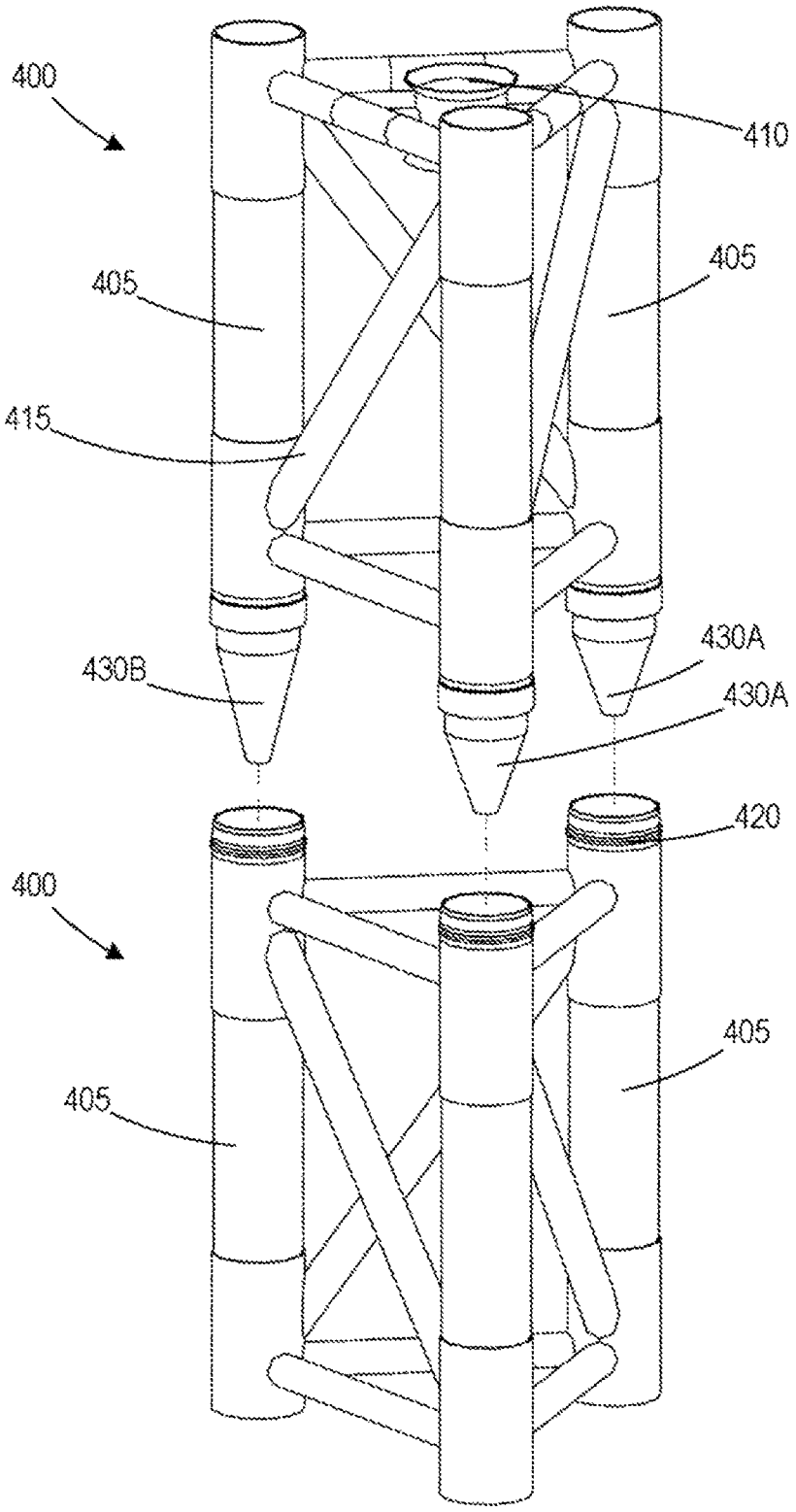

FIG. 4C shows perspective views of two interfacing jacket connector blocks 400, according to some embodiments disclosed herein. The upper jacket connector block 400 includes removable guides 430A, 430B. Note that the removable guide 430B is longer than the removable guides 430 A such that in mates first with the lower jacket connector block 400 to provide an initial alignment and allow subsequent mating with the removable guides 430A. In some embodiments, the removable guides 430 A, 430B are used to provide alignment between the platform deck block 500 and the interfacing jacket connector block 400, or between the jacket connector block 400 and the lower platform block 300.

FIGS. 4D-4J illustrate cut-away views of the removable guides 430A, 430B, according to some embodiments disclosed herein. The removable guides 430A, 430B include body portions 435 and tapered end portions 440. The removable guides 430A, 430B are installed in the interior of the conductor tubes 405. The body portion 435 has a lip 445 that interfaces with a shoulder 450 defined in the conductor tube 405. In some embodiments, the shoulder 450 is a weld bead formed on an interior surface of the conductor tube 405. Locking members 455 engage the lip 445 and the shoulder 450. Each locking member 455 includes a stationary member 460 attached to the lip 445 and the body portion 435, and a cam member 465 rotatably coupled to the stationary member 460. A tab 470 defined in the cam member 465 can pass through a slot 475 defined in the body portion 435 to engage a bottom surface of the shoulder 450. A sling 480 is attached to the cam members 465 to allow retrieval of the removable guides 430 A, 430B. In some embodiments, the removable guides 430 A, 430B are lowered through the conductor tube 405 using the sling 480 until the lip 445 engages the shoulder 450 and the locking member 455 engage. When no lifting force is applied by the sling 480, the cam member 465 rotates toward the wall of the body portion 435 and the wall of the conductor tube 405. The tab 470 passes through the slot 475 and engages a lower surface of the shoulder 450 in a locked position of the locking member 455 (see FIGS. 41 and 4J). The sling 480 is left in a slack state while the two jacket connector blocks 400 shown in FIG. 4B are mated. The locking of the removable guides 430 A, 430B prevents upward movement of the removable guides 430A, 430B in the conductor tube 405 as upward force is encountered during mating process.

After mating of the jacket connector blocks 400, a lifting force is applied by the sling 480 to retrieve the removable guides 430 A, 430B. The sling 480 causes the cam member 465 to rotate away from the wall of the body portion 435 and the wall of the conductor tube 405 to disengage the tab 470 from the shoulder 450 (see unlocked position of the locking member 455 in FIGS. 4G and 4H) and allow retrieval of the removable guides 430 A, 430B through the conductor tube 405.

Figure 4D:
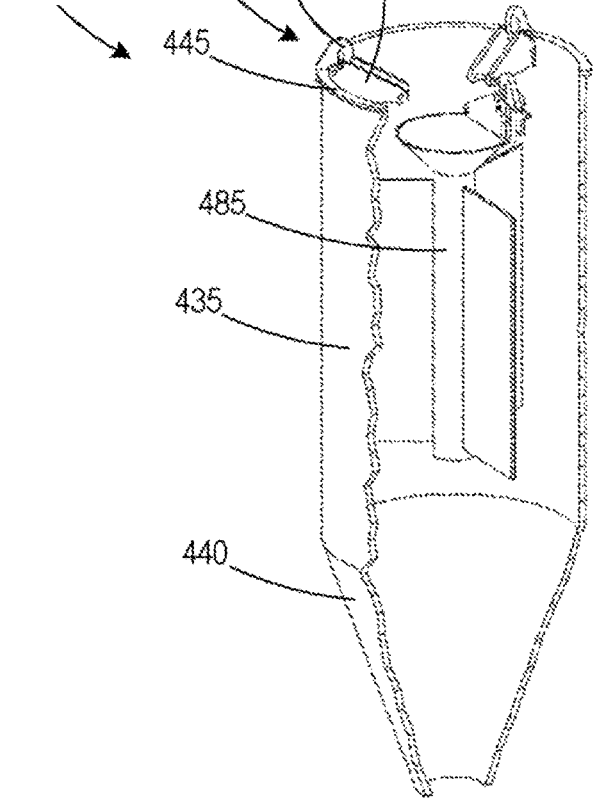
Figure 4E:
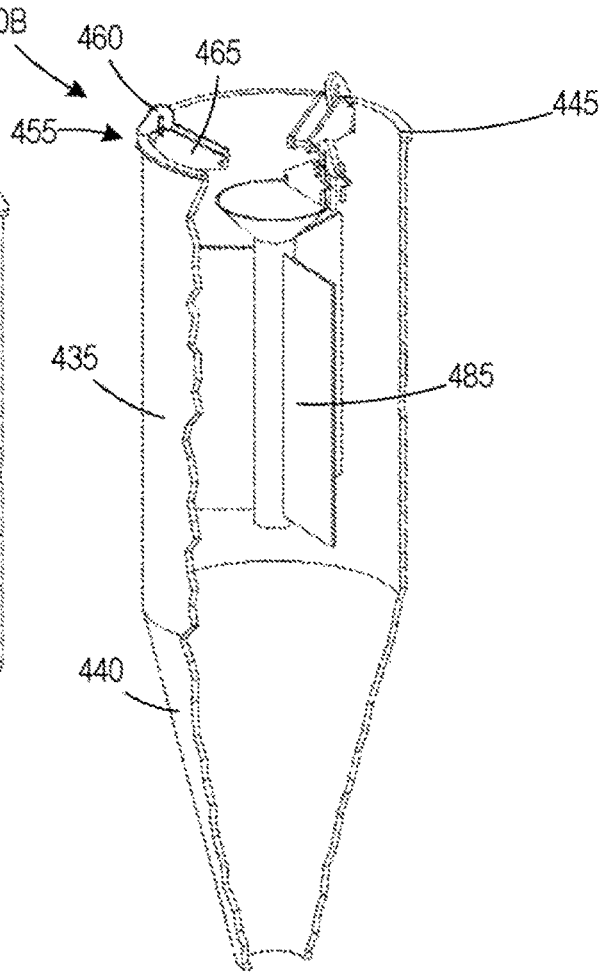
Figures 4F, 4G, 4H, 4I, 4J:
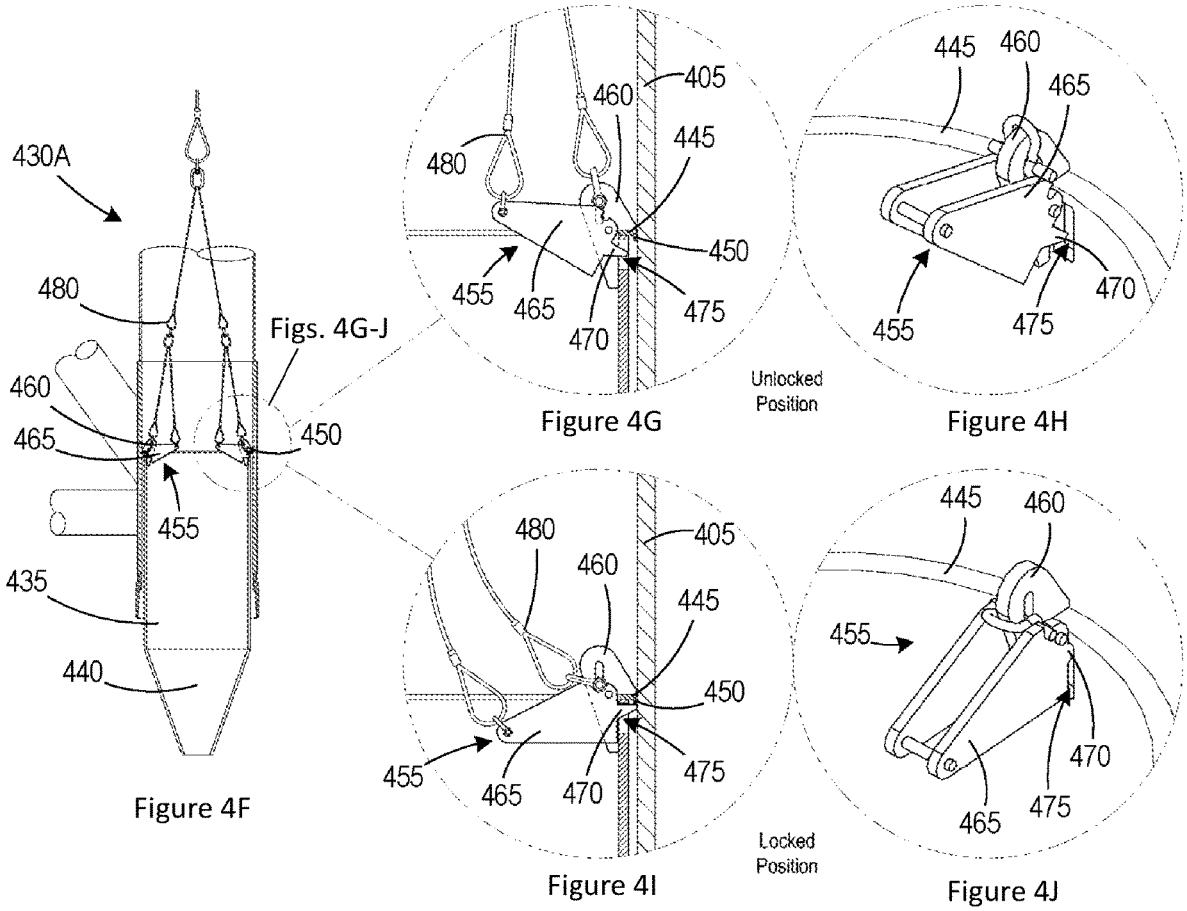

Referring to FIGS. 4D and 4E, in some embodiments, a tubular insert 485 is attached to the body portion 435 to allow removal of the removable guides 430 A, 430B should the sling 480 become unavailable or should a removable guide 430 A, 430B become stuck during retrieval. The tubular insert 485 has the structural strength to allow for a drilling recovery spear removal tool to be run and latched into the removable guide 430A, 430B. A subsequent over-pull will release the locking members 455. In some embodiments, the tubular insert 485 may be used as the only retrieval mechanism, and the sling 480 arrangement may be omitted.

Figure 5:
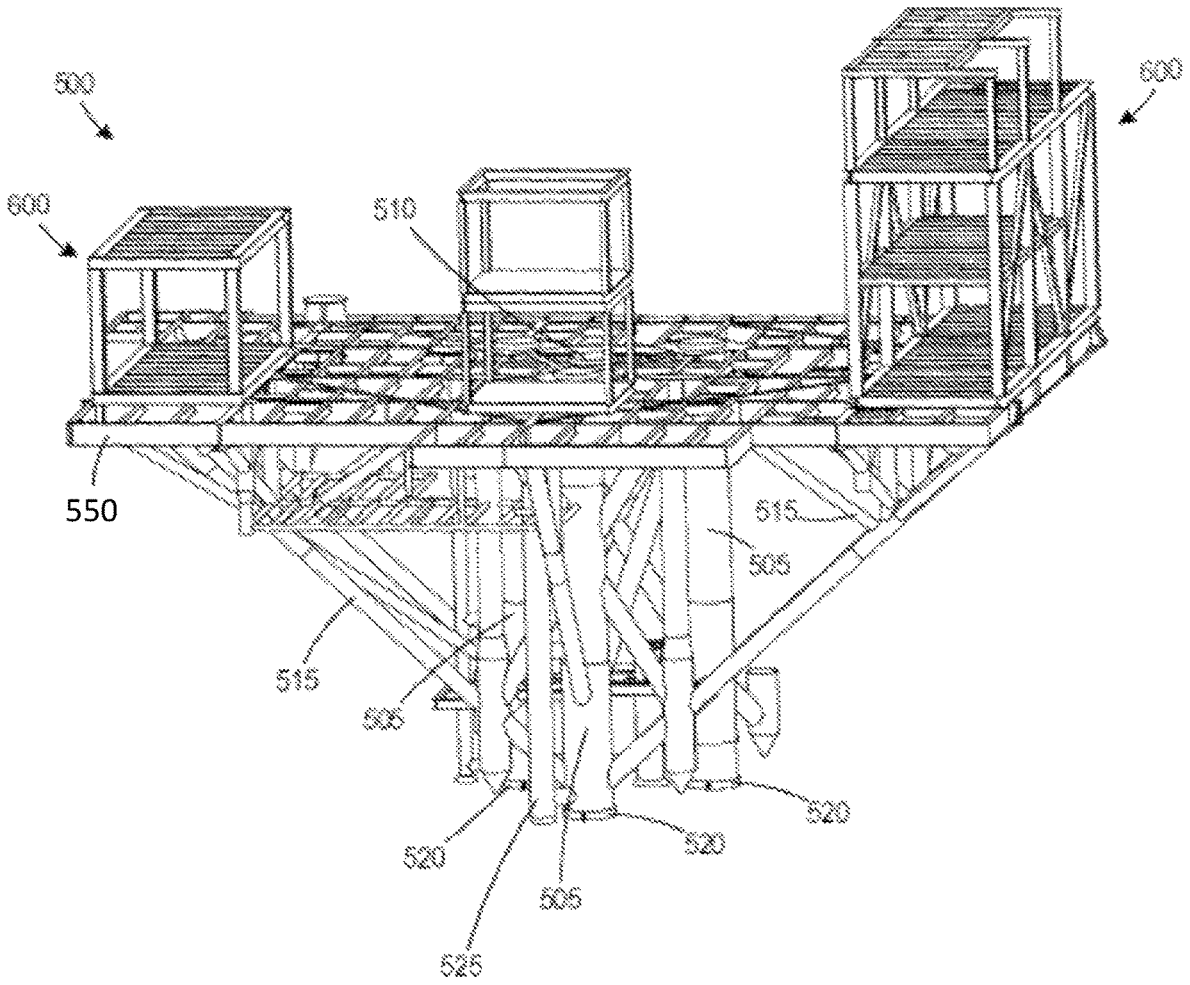
FIG. 5 is a perspective view of a platform deck block, according to some embodiments disclosed herein.

FIG. 5 is a perspective view of the platform deck block 500, according to some embodiments disclosed herein. The platform deck block 500 includes conductor tubes 505 and a center conductor guide 510 supported by a frame 515. The conductor tubes 505 are unobstructed to allow the insertion of conductors 330 The conductor tubes 505 include bottom connectors 520 that lock to the connectors 420 of the jacket connector blocks 400. The frame 515 supports integrated accessory lines 525 (e.g., umbilical or input/export lines) with connector or flanged connections. The frame 515 defines a deck 550 that allows the mounting of production modules 600 thereto.

Figure 6:
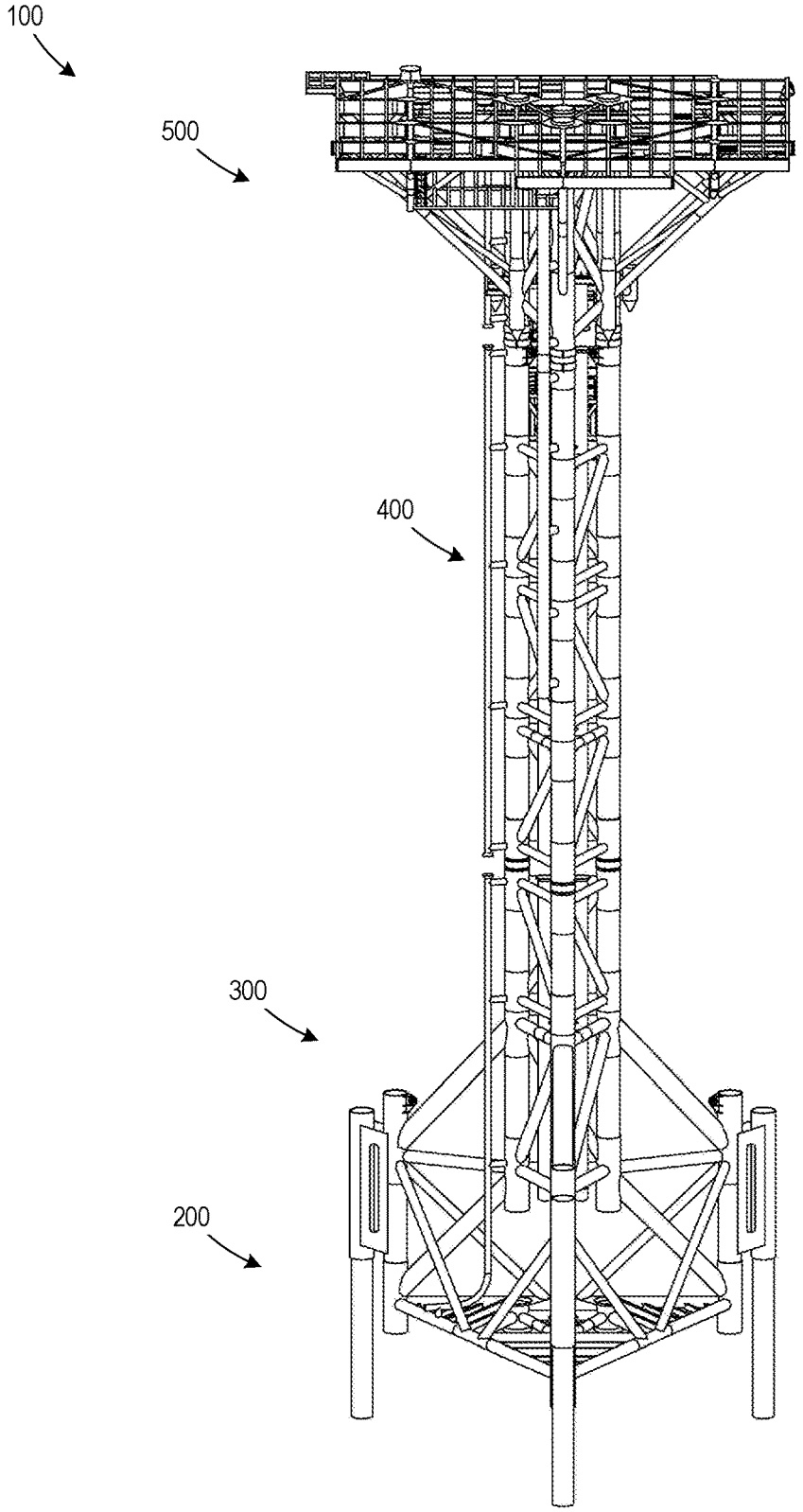
FIG. 6 is a perspective view showing the interconnection of the lower platform block, one or more jacket connector blocks, and the platform deck block, according to some embodiments disclosed herein.

FIG. 6 is a perspective view showing the interconnection of the lower platform block 300, one or more jacket connector blocks 400, and the platform deck block 500, according to some embodiments disclosed herein. In some embodiments, the foundation block 200 of FIG. 2 is coupled to the lower platform block 300. The blocks 200, 300, 400 define a tower for supporting the platform deck block 500.

Figure 7:
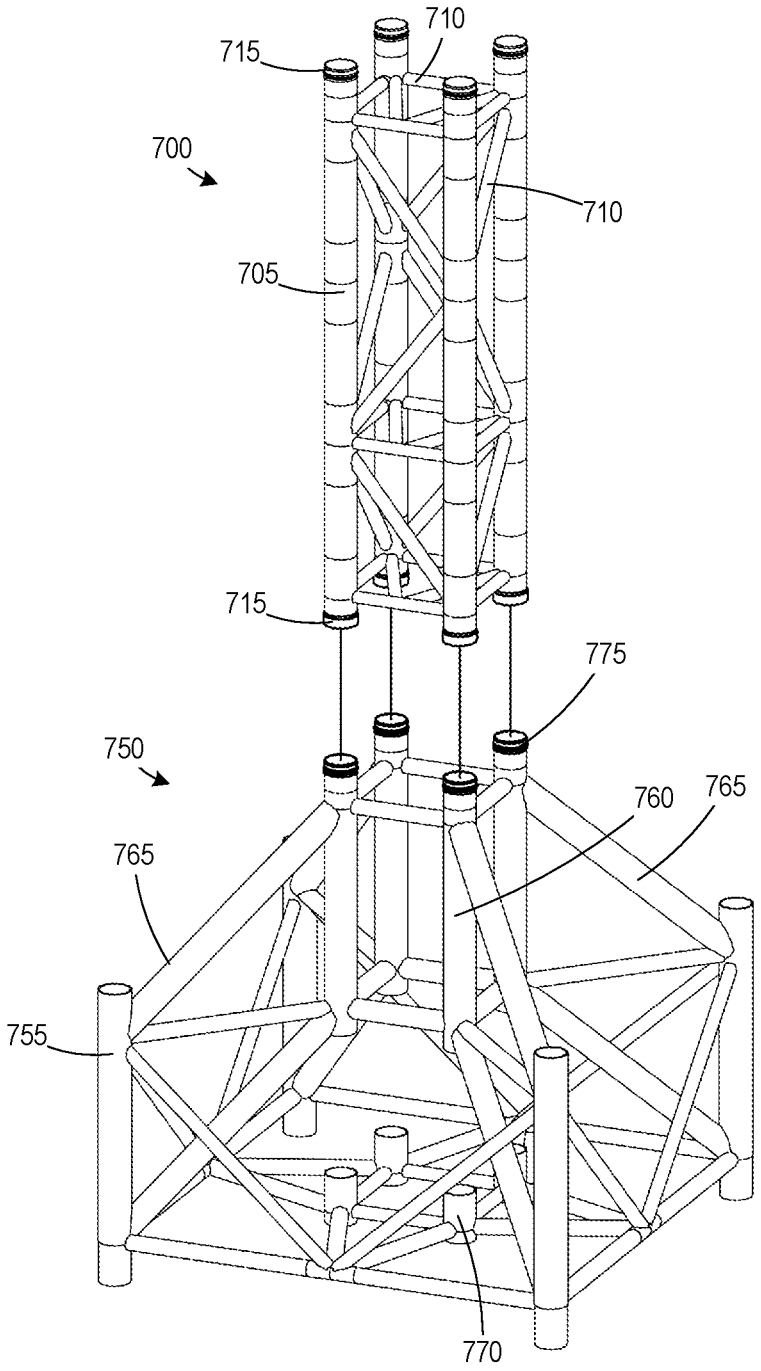
FIG. 7 is a perspective view of an alternative embodiment of a jacket connector block and a lower platform block, according to some embodiments disclosed herein.

FIG. 7 is a perspective view of an alternative embodiment of a jacket connector block 700 and a lower platform block 750, according to some embodiments disclosed herein. The jacket connector block 700 and the lower platform block 750 have a quadpod arrangement, compared to the tripod arrangement of FIG. 4. The jacket connector block 700 includes conductor tubes 705 supported by a frame 710. All four conductors 330 are protected by the conductor tubes 705. The conductor tubes 705 include top and bottom connectors 715 that lock to the connectors 775 of the lower platform block 750 to allow for attaching and separating (i.e., for recovery) jacket connector block 700 from the lower platform block 750.

The lower platform block 750 includes docking or pile tubes 755 and conductor tubes 760 supported by a frame 765. The frame 765 also supports conductor guides 770 that guide the conductors 220 (see FIG. 2) as they are inserted. In some embodiments, the conductor guides 770 may have an upwardly-extending funnel shape to account for misalignment with the conductors 330 during insertion. The conductor tubes 760 include connectors 775 that lock to the connectors 715 of the jacket connector block 700 and the underlying foundation block (not shown), if present to allow for attaching and separating (i.e., for recovery) the lower platform block 750 and the jacket connector block 700. The frame 765 also supports integrated accessory lines (not shown) with connector or flanged connections. The lower platform block 750 supports an installation using a suction can foundation block (not shown), pilings inserted through the docking tubes 755, or a combination of both. The arrangement of the foundation block 200 and the platform deck block 500 would also change to support a quadpod configuration.

Figure 8A:
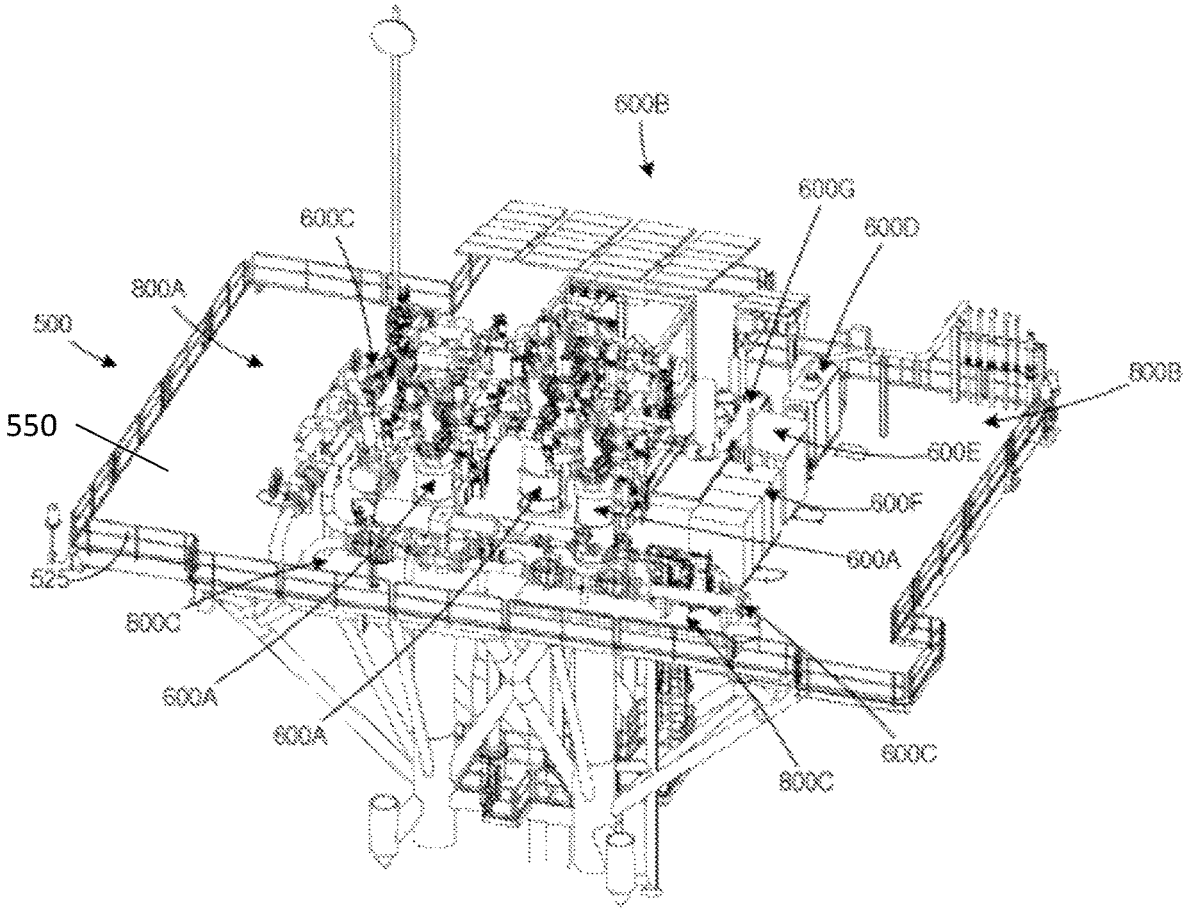
FIGS. 8A and 8B are perspective views of the platform deck block with some equip ent mounted to the deck, according to some embodiments disclosed herein.

FIG. 8A is a perspective view of the platform deck block 500 with some equipment mounted to the deck 550. The deck 550 defines a plurality of docking receptacles 800A, 800B, 800C, each having predetermined geometries to allow various production blocks 600A-600I to be mounted thereto. The receptacles 800A-800C define fixed connection points for all import/export flow lines and fixed well connections. Due to the predetermined geometries with known piping and electrical tie-in configurations, the production blocks 600A-600I may be fabricated off site. The receptacles 800A are capable of supporting large modules or a plurality of smaller modules. The receptacles 800B support small modules, and the receptacles 800C support production piping. Well modules 600A (e.g., single, dual, or triple production wellhead, tree, and choke) are either coupled to the deck 550 or floating with no contact, and align with the conductor tubes 310, 405, 505 or center conductor guides 320, 410, 510 of the underlying blocks 300, 400, 500. In the illustrated embodiment, four vertical well modules 600A are provided. A power module 600B (e.g., solar power panels and batteries) are coupled to the deck 550. Installed modules include pig launcher/receiver modules 600C, a micro-turbine 600D, a control/communication module 600E, a well control package 600F, and an instrument gas package 600G. The particular production blocks 600A-600E initially installed on the deck 550 may vary depending on the installation and implementation time frame.

The receptacles 800A-800C provide configurability of the deck 550 arrangement to account for the initial production requirements, and, as the field matures, to allow the adding or subtracting of production capability by adding or removing production blocks 600A-600I. The various production blocks 600A-600I may be provided on a rental basis to the owner of the universal block platform 100 to reduce fixed capital costs.

Figure 8B:
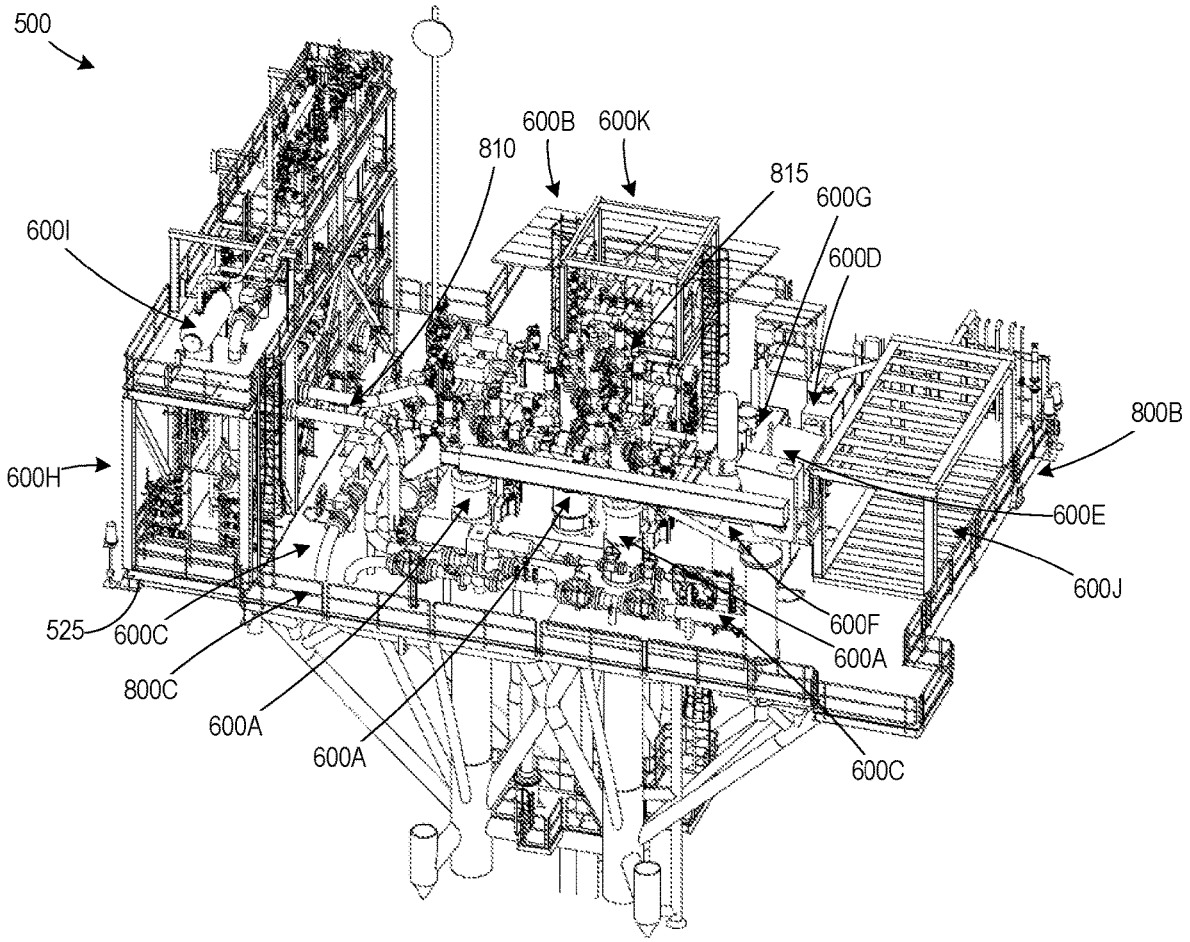

FIG. 8B illustrates the deck 550 after the installation of additional production blocks, including first and second stage processing blocks 600H, a de-watering/sand control processing block 600I, and a chemical/water injection block 600 J. A well expansion module 600K (e.g., vertical or horizontal trees, chokes, and manifolds) was provided to increase the production capacity. Separation/process block feed and return connections 810 connect the blocks 600H, 600I to the main production lines. Well to manifold loops 815 connect the well expansion module 600K to the well modules 600A. Due to the fixed geometry and known connection points, the separation/process block feed and return connections 810 and the well to manifold loops 815 may be prefabricated onsite or offsite.

Figure 9A:
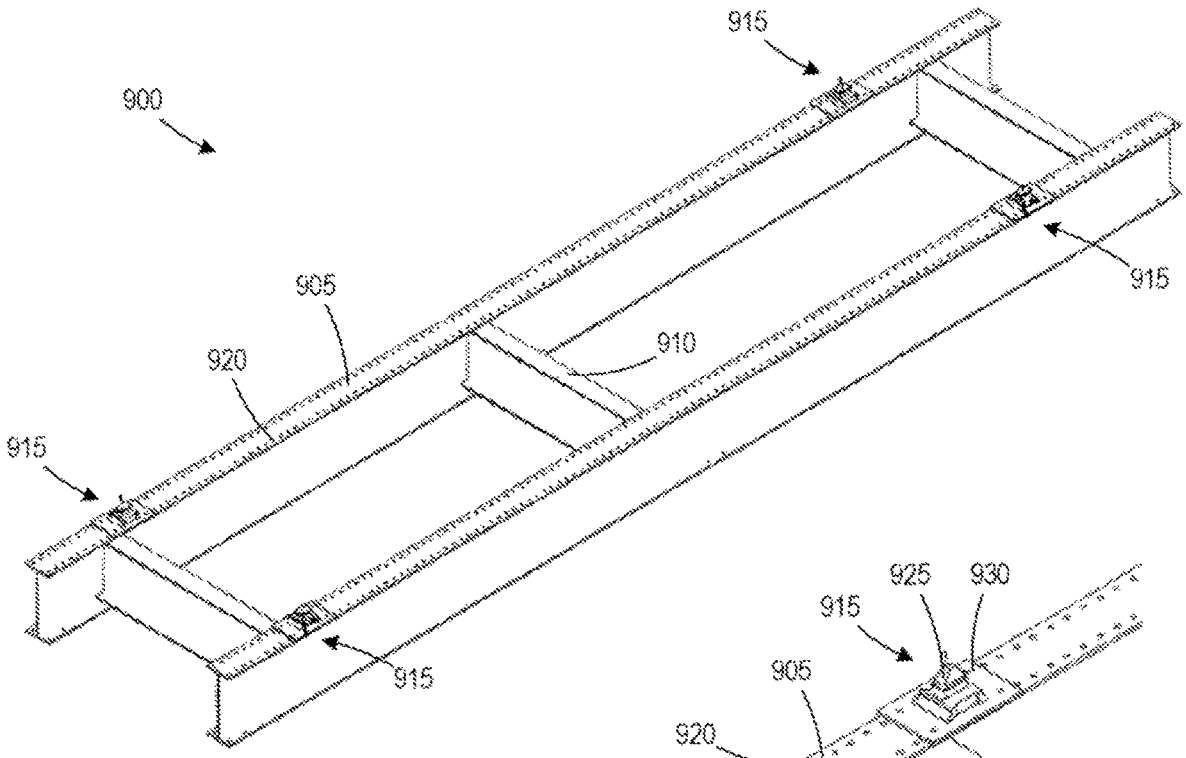
FIGS. 9A-9C are perspective views of portions of a docking receptacle, according to some embodiments disclosed herein.
Figure 9B:
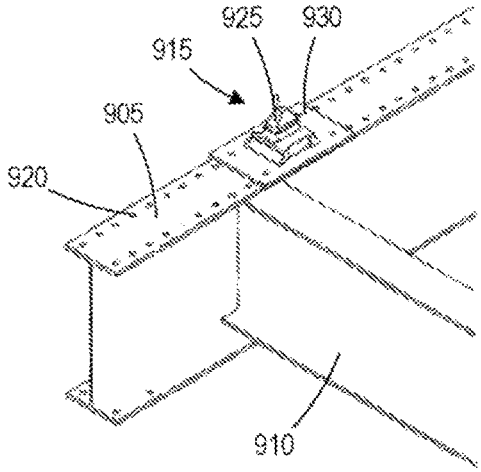
Figure 9C:
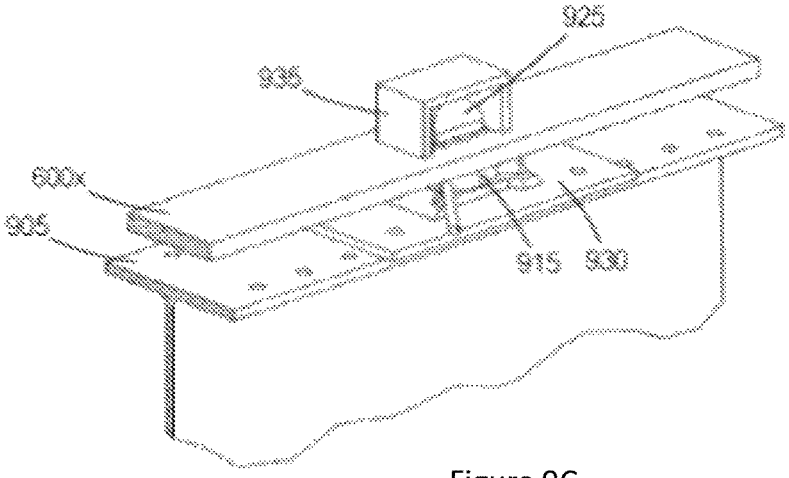

FIGS. 9A-9C illustrate the configuration of a docking receptacle 900, according to some embodiments disclosed herein. The docking receptacle 900 includes fixed frame members 910, 905 and may be mounted to or he part of the deck 550 illustrated in FIG. 5. The docking receptacle 900 provides the adjustable connection points to the production blocks 600A-600K and the deck process pipework. One of the production blocks 600A-600K may be referred to as a production block 600*x*. The docking receptacle 900 includes movable docking nodes 915. The movable docking nodes 915 may be mounted at predefined positions along the fixed frame member 905 at predetermined mounting elements 920 machined in the fixed frame member 910 (e.g., stopper/clamp/bolt hole) depending on the size of the production block 600*x* to be installed. The docking node 915 includes a tapered post 925 (i.e., a male connector) extending from a plate 930. The plate 930 is mounted to the frame member 910 at the predetermined mounting elements 920.

The production block 600*x* includes a female connector 935 that mates with and locks to the tapered post 925 of the node 915 (e.g., using a twist lock mechanism, such as a quarter turn cam lock). All utility connections are routed via the docking receptacle 900 to the production block 600X via tie-in points at fixed locations for instrument air and process gas, electrical power, instrument connections, drain connections, etc.

The production block 600*x* provides the base structure in the fixed envelope to suit the predetermined mounting elements 920 of the docking receptacle 900. This fixed envelope allows the production block 600X to be built within a set of known dimensions and fixed interface points for connection to the docking receptacle 900. The production block 600X houses the various production or separation components as required, along with all the necessary interconnections between the integral components to allow them to work as a single unit. The ability to pre-fabricate the production block 600X allows them to be fully tested and calibrated prior to installation.

In some embodiments, the universal block platform 100 is employed to support functionalities other than wells. The modules 600 provided on the deck 550 depend on the function. The deck 550 may be configured to support a water and gas injection module, a process hub module with no drilled wells on the platform, a gas or oil gathering hub module with fiscal metering, an accommodation modules (e.g., housing, office space, etc.), a wind power module, a power transmission module, a helicopter landing pad, etc. In some embodiments, multiple universal block platforms 100 are connected in a hub and spoke configuration. One platform 100 may support well operations, one platform 100 may support a gathering hub, one platform 100 may support accommodations, one platform 100 may serve as a helicopter landing pad, etc. In such embodiments without well functionality, the conductor tubes 310, 405, 505 of the blocks 300, 400, 500, respectively, do not serve as conduits for routing conductors, but rather serve as structural tubes for supporting the universal block platform 100.

The universal block platform 100 provides a pre-engineered, flexible, low cost, light weight platform design that allows platform blocks to be built and stocked to reduce cycle times and provide flexibility in field development. The universal block platform 100 allows the development of a portfolio field in a hub and spoke network arrangement, facilitating the development of the fields in an incremental fashion to facilitate the sanction point. During the entire life cycle of the universal block platform 100, components may be swapped or added to suit the production economics. The universal block platform 100 fundamentally reduces the internal sanction point for development of a marginal field by increasing the capital deployment efficiency. The universal platform block 100 eliminates the need for site-specific engineering, thus allowing the full range of production requirements to be managed off the critical path, where production and process capabilities can be added or removed without the need for structural or design changes throughout the service life.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. An apparatus, comprising:

a lower platform block, comprising:

a first frame;

a plurality of docking assemblies connected to the first frame, wherein each docking assembly comprises:

a pile tube;

a frame tube coupled to the first frame; and a web coupling the frame tube to the pile tube, wherein a window is defined in the web;

a plurality of conductor tubes connected to the first frame; and a first plurality of releasable connectors coupled to the conductor tubes; and a mudmat coupled to a lower portion of the first frame, wherein the mudmat comprises a plurality of wing members spanning across first and second elements of the first frame, wherein each wing member has an arcuate cross-section, and wherein a thickness of each wing member increases along an arc of the arcuate cross-section.

2. The apparatus of claim 1, wherein the lower platform block further comprises a plurality of first conductor guides connected to a bottom portion of the first frame and aligned with the conductor tubes.

3. The apparatus of claim 2, wherein the lower platform block further comprises a second conductor guide positioned in a center region of the bottom portion, wherein the second conductor guide is not aligned with one of the conductor tubes.

4. The apparatus of claim 1, further comprising:

a foundation block coupled to the lower platform dock, comprising:

a second frame;

a plurality of suction cans coupled to the second frame; and a plurality of piles coupled to the second frame, wherein the piles engage the docking assemblies.

5. The apparatus of claim 4, wherein the pile tube engages one of the plurality of piles.

6. A method, comprising:

mounting a lower platform block to a plurality of piles positioned on a surface, wherein the lower platform block comprises a first frame, a plurality of docking assemblies connected to the first frame and engaging the plurality of piles, and a plurality of conductor tubes connected to the first frame to engage the plurality of piles, wherein each docking assembly comprises a pile tube, a frame tube coupled to the first frame, and a web coupling the frame tube to the piled tube, and a window is defined in the web; and releasing the docking assemblies from the piles to separate the lower platform block from the piles by cutting the web, wherein the lower platform block further comprises a mudmat coupled to a lower portion of the first frame, and the method further comprises placing the lower platform block to engage the mudmat with the surface, wherein the mudmat comprises a plurality of wing members spanning across first and second elements of the first frame, wherein each wing member has an arcuate cross-section, and wherein a thickness of each wing member increases along an arc of the arcuate cross-section.

7. The method of claim 6, further comprising:

placing the lower platform block on the surface; and installing the plurality of piles in the surface through the docking assemblies.

8. The method of claim 6, wherein the lower platform block further comprises a conductor guide connected to the first frame and not aligned with the conductor tubes, the method further comprising:

installing a pipe in the surface through the conductor guide; and installing the plurality of piles in the surface through the docking assemblies.

9. The method of claim 6, further comprising:

placing a foundation block on the surface, wherein the foundation block comprises a second frame and a plurality of suction cans coupled to the second frame, wherein the plurality of piles are coupled to the second frame; and engaging the plurality of docking assemblies with the plurality of piles to couple the lower platform block to the foundation block.

10. The method of claim 9, further comprising cutting the web to release the lower platform block from the plurality of piles.

* * * * *